343-909 SR
6/1/76 XR 3,961,333

United States Patent [19]
Purinton

[11] 3,961,333
[45] June 1, 1976

[54] RADOME WIRE GRID HAVING LOW PASS FREQUENCY CHARACTERISTICS

[75] Inventor: Donald L. Purinton, Richardson, Tex.

[73] Assignee: Texas Instruments Incorporated, Dallas, Tex.

[22] Filed: Aug. 29, 1974

[21] Appl. No.: 501,518

[52] U.S. Cl. ..... 343/872; 343/909
[51] Int. Cl.[2] ..... H01Q 1/42
[58] Field of Search ..... 343/872, 909, 910, 911 R

[56] References Cited

UNITED STATES PATENTS

| | | | |
|---|---|---|---|
| 2,841,786 | 7/1958 | Dicke | 343/872 |
| 3,633,206 | 1/1972 | McMillan | 343/872 |
| 3,864,690 | 2/1975 | Pierrot | 343/872 |

OTHER PUBLICATIONS

Kennedy: An Analysis of the Elec. Characteristics of Structurally Supported Radomes; Nov. 1958; pp. 59, 60 RADC-TN-59-91.

*Primary Examiner*—Eli Lieberman
*Attorney, Agent, or Firm*—Harold Levine; Rene' E. Grossman; Alva H. Bandy

[57] ABSTRACT

Disclosed is a wire grid for tuning a radome or irdome to pass microwave frequency energy while not interfering with the passage of lower radio frequencies such as those used for communications. The wire grid is embedded in the dome material and comprises a plurality of small closely packed wire loops. The close packing of the wire loops provides capacitive coupling between adjacent loops. At microwave frequencies the capacitive coupling between loops makes the pattern equivalent to the prior art continuous wire grid pattern and enhances transmission of a band of microwave frequencies. At low radio frequencies the capacitive coupling between loops is insignificant and the low frequency signals pass through the dome with no reflection. Intermediate frequency signals are attenuated by the wire grid.

5 Claims, 8 Drawing Figures

Fig. 1
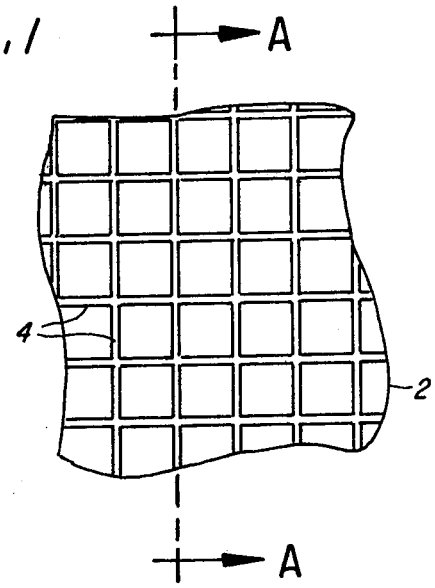
Fig. 2
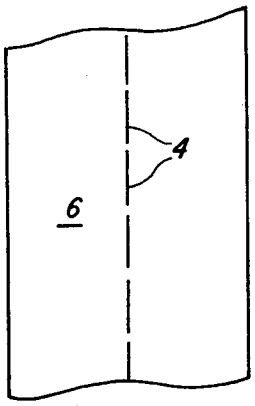
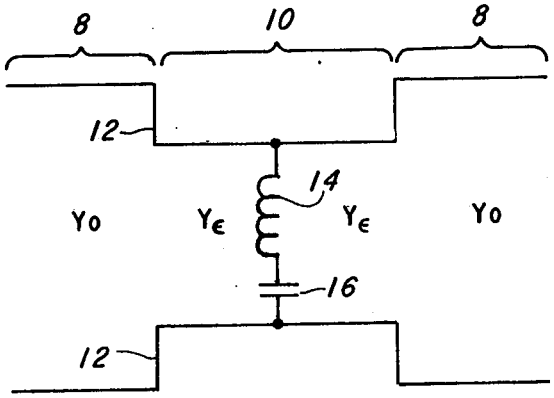
Fig. 3
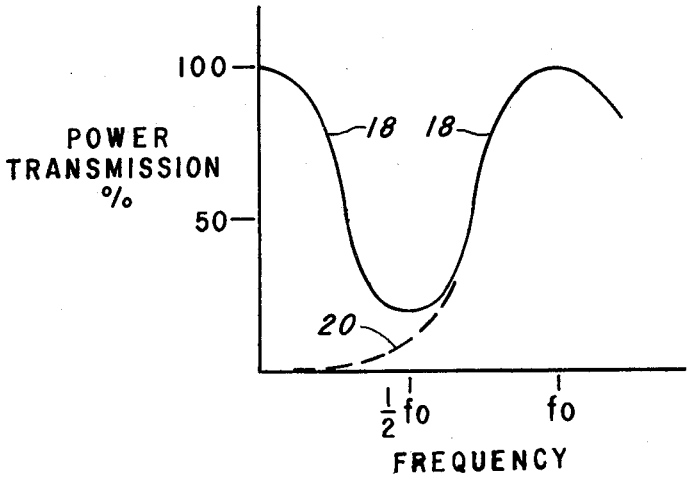
Fig. 4

Fig. 5
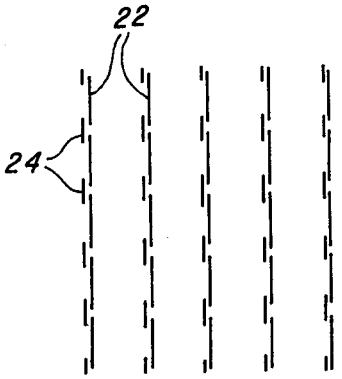
Fig. 6
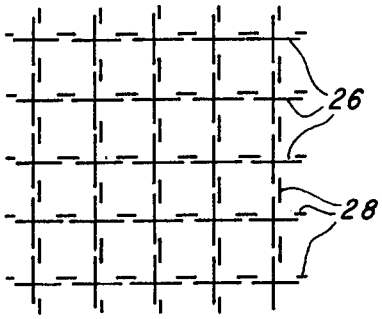
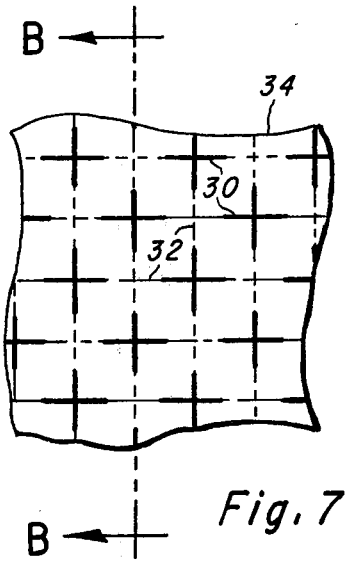
Fig. 7
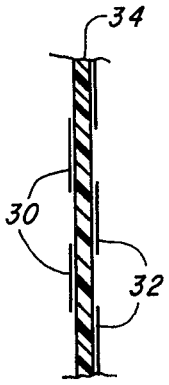
Fig. 8

RADOME WIRE GRID HAVING LOW PASS FREQUENCY CHARACTERISTICS

This invention relates to improved radomes or irdomes and more particularly to wire grids for use in radomes or irdomes to improve transmission of radio frequency energy.

Radar antennas are generally not suited for direct exposure to atmospheric conditions and thus must often be protected by a radome. In airborne applications a radome not only protects a radar antenna from high velocity wind but also provides a streamlined structure compatible with the aerodynamic design of the aircraft. In any case where a radome is used, it is highly desirable that the radar signals pass through the radome with no reflection or distortion. Since practically all radome materials have a dielectric constant different from that of air, most simple radomes do cause reflections of energy at the dielectric interfaces. In systems where the reflections cannot be tolerated, it has become common practice to embed a wire mesh or screen into the radome material itself to aid in the transmission of microwave energy. The embedded wire mesh appears inductive to the radio frequency signal, and the inductance can be arranged to offset the capacitance of the radome dielectric material. A characterization of this inductance is given by N. A. Marcuvitz, *WAVE GUIDE HANDBOOK* (McGraw-Hill Book Co., 1951) p 284–5. By proper design a radome can be built which will pass a band of frequencies centered on any desired operating radar frequency.

It is often desirable, particularly in airborne systems, to pass a lower radio frequency signal through a radome tuned to a microwave frequency. The prior art metal grids cause a problem in this situation due to the tuning characteristics. Frequencies more than one octave below the pass band center frequency are practically impossible to pass through a radome having a continuous wire grid.

Infrared and visible light detectors are even more sensitive to atmospheric conditions and must be operated at a low temperature. Protective windows or domes of infrared transparent material such as magnesium flouride are often provided. These windows are termed irdomes even through most are also transparent to visible light and are commonly used as optical domes. It is often desirable in airborne systems to pass radio frequency signals through an irdome instead of providing a separate radome. Irdome materials are dielectrics generally having a higher dielectric constant than most radome materials. Thus, the same reflection and distortion problems occur when radar frequencies are transmitted through a radome. While irdome apertures are normally small it is often desirable to pass relatively low radio frequencies through a radome designed to pass both light and radar frequency energy. As with radomes, a continuous wire grid which tunes an irdome to pass a band of microwave frequencies also prevents transmission of low radio frequency through the irdome.

Accordingly, it is the object of the present invention to provide an improved wire grid for increasing the transmission of radar frequency energy through a radome or an irdome.

It is also an object of the present invention to provide a wire grid for a radome or irdome for use with combined radar and communications transmitters and receivers.

The above and other objects are achieved by providing a split or broken wire grid for a radome or irdome. The wire grid segments are closely packed to provide capacitive coupling between adjacent segments. At radar frequencies the capacitive coupling is an effective short circuit and makes the wire grid segments the electrical equivalent of a continuous wire grid pattern. At low radio frequencies the capacitance between the wire segments is an effective open circuit and the grid pattern does not interfere with the transmission of the radio frequency energy.

Other objects, features and advantages of this invention will become better understood by reference to the following detailed description when read in conjunction with the accompanying drawings wherein:

FIG. 1 is an illustration of a section of a radome comprising an embodiment of this invention.

FIG. 2 is a cross section view along line AA of the radome section of FIG. 1.

FIG. 3 is a schematic diagram of the equivalent circuit of the radome section illustrated in FIG. 2.

FIG. 4 is a plot of the power transmission characteristics of a radome comprising the present invention plotted vs. frequency.

FIG. 5 is an illustration of another embodiment of the present invention for use with linearly polarized signals.

FIG. 6 is an illustration of another embodiment of the present invention.

FIG. 7 is an illustration of another embodiment of the present invention.

FIG. 8 is a cross section view along line BB of the embodiment of FIG. 7.

FIGS. 1 and 2 illustrate a section of a radome built according to the present invention. The metal grid pattern illustrated in FIG. 1 is simply a plurality of square loops 4 packed closely together relative to the size of the loops. The loops 4 typically have an edge dimension of 0.25 inch, are spaced 0.005 inch apart, and are formed of copper conductors 0.005 inch wide. Each of these dimensions is selected according to a particular radar frequency which the radome is designed to pass and according to the radome dielectric constant. The grid pattern illustrated in FIG. 1 can be seen as a split wire grid as well as a set of square loops 4. Any common continuous wire grid pattern may be modified for transmitting low radio frequencies by splitting each wire of the grid into two smaller spaced wires. Thus the prior art equivalent of the grid of FIG. 1 is a simple grid of 0.010 inch wide conductors spaced on 0.25 inch centers.

The loops 4 are preferably formed by etching a copper layer on a thin sheet of dielectric material by common printed circuit board techniques. The loops 4 may also be formed from wire or by stamping from sheet metal. As illustrated by FIG. 2, the loops 4 are embedded in the center of a dielectric layer 6 forming the mechanical structure of the radome. Most radomes are constructed of layers of plastic and fiberglass materials and the grid pattern is simply sandwiched between layers.

The term irdome as used in this application includes optical domes for passing visible as well as infrared light. Construction of an irdome having a wire grid is more difficult due to the fact that irdome materials are typically glass or ceramic. To place a grid at the center of an irdome requires either that the dome be made in two concentric pieces so a grid can be evaporated onto the inner section, or that a high temperature metal be used for the grid so that it may be embedded as the dome is formed. Alternately two grids may be used to tune an irdome by applying a pattern to both the inner and outer dome surfaces. Since the grid wire width is small compared to grid spacing only a small reduction of IR transmission results from the application of a tuning grid to an irdome.

FIG. 3 illustrates the electrical equivalent circuit of the radome of FIGS. 1 and 2. Conductorss 12 are the wires of a two wire transmission line. Two sections 8 of the transmission line represent free space and have an admittance equal to $Y_0$. A section 10 of the transmission line represents the dielectric 6 of FIG. 2 and has a characteristic admittance of $Y_\epsilon$ . The wires 12 are more closely spaced in the region 10 to represent the increased capacitance caused by the dielectric material 6. The change in characteristic admittance between region 10 and region 8 represents a discontinuity on the transmission line and tends to cause reflections of signals carried on the transmission line. An inductance 14 and a capacitance 16 are the electrical equivalent of the grid pattern 4 illustrated in FIG. 2. As with the prior art continuous wire grid patterns, the inductor 14 has the proper inductance to balance the increased capacitance in section 10 of the transmission line at a preselected frequency. The value of inductance 14 is determined by the size and shape of the grid pattern 4 and thus is directly within the control of the radome designer. The capacitance 16 represents the capacitive coupling between adjacent loops 4. This capacitance value must be large enough to appear essentially as a short circuit relative to the inductor 14 at the desired radar frequency. Capacitance 16 is also within the control of the radome designer since it is determined by the spacing between loops 4. If additional capacitance between loops is needed the wire loop pattern is arranged in two layers with each layer slightly overlapping the other.

In operation the electrical character of the grid pattern of FIG. 1 changes with frequency. At a preselected radar frequency the capacitance between loops is essentially a short circuit and the pattern is equivalent to a continuous wire grid. The inductance of the wire grid offsets the radome dielectric capacitance to make the radome essentially transparent to radio frequency energy at the preselected radar frequency. At low radio frequencies, for example, below one half the preselected radar frequency, the capacitance between loops is essentially an open circuit and the pattern appears as only a group of isolated metal inclusions. The size of the metal inclusions and the thickness of the radome dielectric both become smaller percentages of a wavelength as frequency decreases and thus have less effect on transmission. The low frequency signals such as are commonly used for communication and navigation equipment may therefore be transmitted through the radome with only slight degradation caused by an equivalent transmission line impedance mismatch.

FIG. 4 illustrates the power transmission characteristics of the radome of FIGS. 1 and 2 plotted vs. frequency. The frequency $f_0$ on the frequency scale is a radar frequency at which the radome must appear essentially transparent. The inductance 14 of FIG. 2 is designed to balance the dielectric capacitance of the radome at $f_0$. In the plot of FIG. 4, the radome transmits essentially one hundred percent of the radio frequency energy at $f_0$. As frequency is increased or decreased from $f_0$, the percent transmission rapidly decreases due to the bandpass nature of wire grid tuning. At frequencies below approximately one half $f_0$ the power transmission of the radome of the present invention increases again sharply and is approximately one hundred percent again at signals less than one eighth $f_0$. While the prior art continuous wire grid radome has approximately the same transmission characteristics between two thirds $f_0$ and $f_0$, there is a tremendous difference below one half $f_0$. The dashed line plot 20 illustrates the power transmission of a continuous wire grid as used in the prior art. The prior art continuous wire grid appears essentially as a short circuit to low frequencies signals and thus the plot 20 continues to decrease towards zero as frequency is decreased below one half $f_0$.

FIG. 5 illustrates another embodiment of the present invention for use with linearly polarized radar signals. The wire array is essentially a set of parallel wires which have been broken into segments 22. Since the capacitive coupling between the ends of segments 22 is small, additional wire segments 24 are used to capacitively bridge the gaps between segments 22. This wire array affects a capacitive radome or irdome in the same way that the close packed loop does, but not only with respect to one polarization of RF energy. Only RF signals having an electrical field component parallel to the wire segments 22 interact with this pattern. A radome having this pattern is therefore transparent only to signals having this polarization.

FIG. 6 illustrates a two dimensional square tuning grid electrically similar to that of FIG. 2. This square grid is broken into cross shaped segments 26 which are capacitively coupled at their ends. As with the polarized array of FIG. 5, additional line segments 28 are used to obtain sufficient capacitive coupling between the ends of the segments. The grid of FIG. 6 is electrically equivalent to that of FIG. 1 and its electrical operation is the same.

The additional wire segments 24 and 28 of FIGS. 5 and 6, respectively, are needed only in the cases where sufficient coupling cannot be achieved by close spacing of the ends of the wire segments 22 or 26. Although the capacitance between the ends of wire segments is small it is often sufficient at higher radar frequencies to effectively couple the segments.

FIGS. 7 and 8 illustrate another square wire grid which is electrically equivalent to those of FIGS. 1 and 6. The grid is broken into cross shaped segments 30 and 32 each having arms longer than one half the square loop edge dimension. Alternate segments are placed on opposite sides of a thin dielectric sheet 34. The ends of the cross arms thus overlap each other providing capacitive coupling between segments. This grid is also the electrical equivalent of that illustrated in FIG. 1 and its electrical operation is the same.

All of the above embodiments are suitable for radomes or irdomes in which radar frequency signals have substantially normal angle of incidence to the dome wall. As is well known in the prior art, tuning wire grid patterns must be modified when the radiation angle of incidence deviates significantly from perpendicular. It will be apparent that the present invention applies equally well to the high angle of incidence tuning grid patterns. Detailed design parameters and examples for the prior art continuous wire grids are available in a variety of publications such as M. A. Teichman, "Designing Wire Grids for Impedance Matching of Dielectric Sheets," Microwave Journal, Vol. II, No. 4, Apr. 1968, pp. 73–78.

Although the present invention has been shown and illustrated in terms of specific apparatus, it will be apparent that changes or modifications can be made without departing from the spirit and scope of the invention as defined by the appended claims.

What is claimed is:

1. A radome comprising:

a sheet of dielectric material forming a window, a plurality of discontinuous electrical conductors forming a linear grid embedded within said sheet, and distributed capacitor means for coupling said plurality of conductors together across points of discontinuity to provide capacitance and inductance at a preselected radar frequency, whereby said radome passes radio frequency energy at said radar frequency with substantially no attenuation and also passes radio frequency energy at frequencies less than about one half said preselected radar frequency.

2. A radome according to claim 1 wherein said capacitor means are electrical conductors embedded within said sheet selectively spaced from said discontinuous conductors to provide capacitance across the points of discontinuity.

3. A radome comprising:

a. a sheet of dielectric material;

b. a first set of wire conductor segments planarly embedded in said sheet of dielectric material in a spaced end to end relationship; and c. a second set of wire conductor segments embedded within said sheet of dielectric material, said second set of wire conductor segments spaced from and overlapping end portions of said first set of wire conductor segments to capacitively bridge spaced end portions of the first set of wire conductors, whereby at a preselected frequency the capacitance is essentially a short circuit and the pattern is equivalent to a continuous wire grid and below frequencies about one-half the preselected frequency, the capacitance is essentially an open circuit and the patterm appears as a group of isolated metal inclusions.

4. A radome according to claim 3 wherein said first and second sets of wire conductor segments form a plurality of parallel spaced capacitively coupled wires whereby only RF signals having an electrical field component parallel to the first set of wire conductor segments interact therewith.

5. A radome according to claim 3 wherein said first set of wire conductor segments form a plurality of horizontally and vertically spaced parallel lines in the dielectric sheet, each line having wire segments positioned end to end in a spaced relationship, and a second set of wire conductor segments spaced from and overlapping end portions of the first set of wire conductor segments to capacitively bridge the end portions of successive wire conductor segments of the first set of wire conductor segments.

* * * * *